US006328067B1

(12) United States Patent
Hsiung

(10) Patent No.: US 6,328,067 B1
(45) Date of Patent: Dec. 11, 2001

(54) KITCHEN USE FAUCET STRUCTURE

(76) Inventor: Chao-Pei Hsiung, No.49, Rueyan Street, Taipei (TW)

( * ) Notice: Subject to any disclaimer, the term of this patent is extended or adjusted under 35 U.S.C. 154(b) by 0 days.

(21) Appl. No.: 09/606,217

(22) Filed: Jun. 29, 2000

(51) Int. Cl.[7] ..... E03C 1/04
(52) U.S. Cl. ..... 137/615; 4/677; 137/801
(58) Field of Search ..... 4/677; 137/615, 137/801

(56) References Cited

U.S. PATENT DOCUMENTS 3,373,770 * 3/1968 Ward et al. ..... 137/615
3,653,407 * 4/1972 Katva ..... 137/615
4,262,699 * 4/1981 Fabian ..... 137/615 X

* cited by examiner

*Primary Examiner*—Gerald A. Michalsky
(74) *Attorney, Agent, or Firm*—Rosenberg, Klein & Lee

(57) ABSTRACT

A kitchen use faucet structure includes a faucet having a lower end fitting hole for receiving a fixed base and having a screw hole for allowing passage of a locking screw which is secured in an annular limiting groove defined in the outer wall of the fixed base so that the faucet is pivoted on the fixed base, the fixed base provided with two introducing holes for securing two cold/hot water tubes, a cold water introducing chamber connecting to one of the two introducing holes and provided with a cold flow tube, a hot water introducing chamber connecting to the other of the two introducing holes, a cold water fitting hole defined in the faucet for receiving the cold flow tube, a cold water chamber defined in the faucet and connecting to the cold water fitting hole, a hot water chamber defined in the faucet and connecting to the outlet of the hot water introducing chamber, the cold water chamber and the hot water chamber each having an upper end defining a fitting hole for receiving two fitting posts of a control device.

1 Claim, 4 Drawing Sheets

KITCHEN USE FAUCET STRUCTURE

BACKGROUND OF THE INVENTION

1. Field of the Invention

The present invention relates to a kitchen use faucet structure.

2. Description of the Related Art

A conventional kitchen use faucet structure in accordance with the prior art comprises a fixed base secured on the sink of the kitchen, a faucet pivotally mounted on the fixed base, a cold water tube and a hot water tube each having a distal end extending through the fixed base and secured to a water introducing hole defined in the faucet to supply water into the faucet when the faucet is pivoted on the fixed base. However, the faucet cannot be conveniently pivoted on the fixed base due to interference of the cold water tube and the hot water tube so that when the faucet is pivoted to a determined angle, it will be pulled backward to an extent by the restoring action of the cold water tube and the hot water tube, thereby limiting the mobility of the faucet.

SUMMARY OF THE INVENTION

In accordance with one aspect of the present invention, there is provided a kitchen use faucet structure comprising: a cylindrical fixed base having a lower end defining two fixed screw holes for locking the fixed base to a sink by two screws, a faucet having a lower end fitting hole for receiving the fixed base therein and having a screw hole for allowing passage of a locking screw which is secured in an annular limiting groove which is defined in an outer wall of a mediate portion of the fixed base so that the faucet is pivoted on the fixed base, the limiting groove having a top and a bottom each having an abutting step for supporting a slide sleeve which is slidable in an inner wall of the lower end fitting hole of the faucet for facilitating the faucet pivoting on the fixed base, the improvement comprising: the lower end of the fixed base being provided with two threaded introducing holes for securing the lower end of the fixed base to two cold/hot water tubes; a cold water introducing chamber defined in the fixed base and having an inlet connecting to one of the two introducing holes and an outlet extending to a top of the fixed base and provided with a cold flow tube protruding outward; a hot water introducing chamber defined in the fixed base and having an inlet connecting to the other of the two introducing holes and an outlet extending to the top of the fixed base and located adjacent to the cold flow tube; the cold flow tube and an upper end of the fixed base each having an outer wall defining an annular groove for receiving a sealing ring; a cold water fitting hole defined in a top of the lower end fitting hole of the faucet for receiving the cold flow tube, a cold water chamber defined in an upper end of the faucet and connecting to the cold water fitting hole, a hot water chamber defined in the top of the lower end fitting hole of the faucet and connecting to the outlet of the hot water introducing chamber, the cold water chamber and the hot water chamber each having an upper end defining a fitting hole for receiving two fitting posts of a control device.

Further benefits and advantages of the present invention will become apparent after a careful reading of the detailed description with appropriate reference to the accompanying drawings.

DETAILED DESCRIPTION OF THE INVENTION

Figure 1:
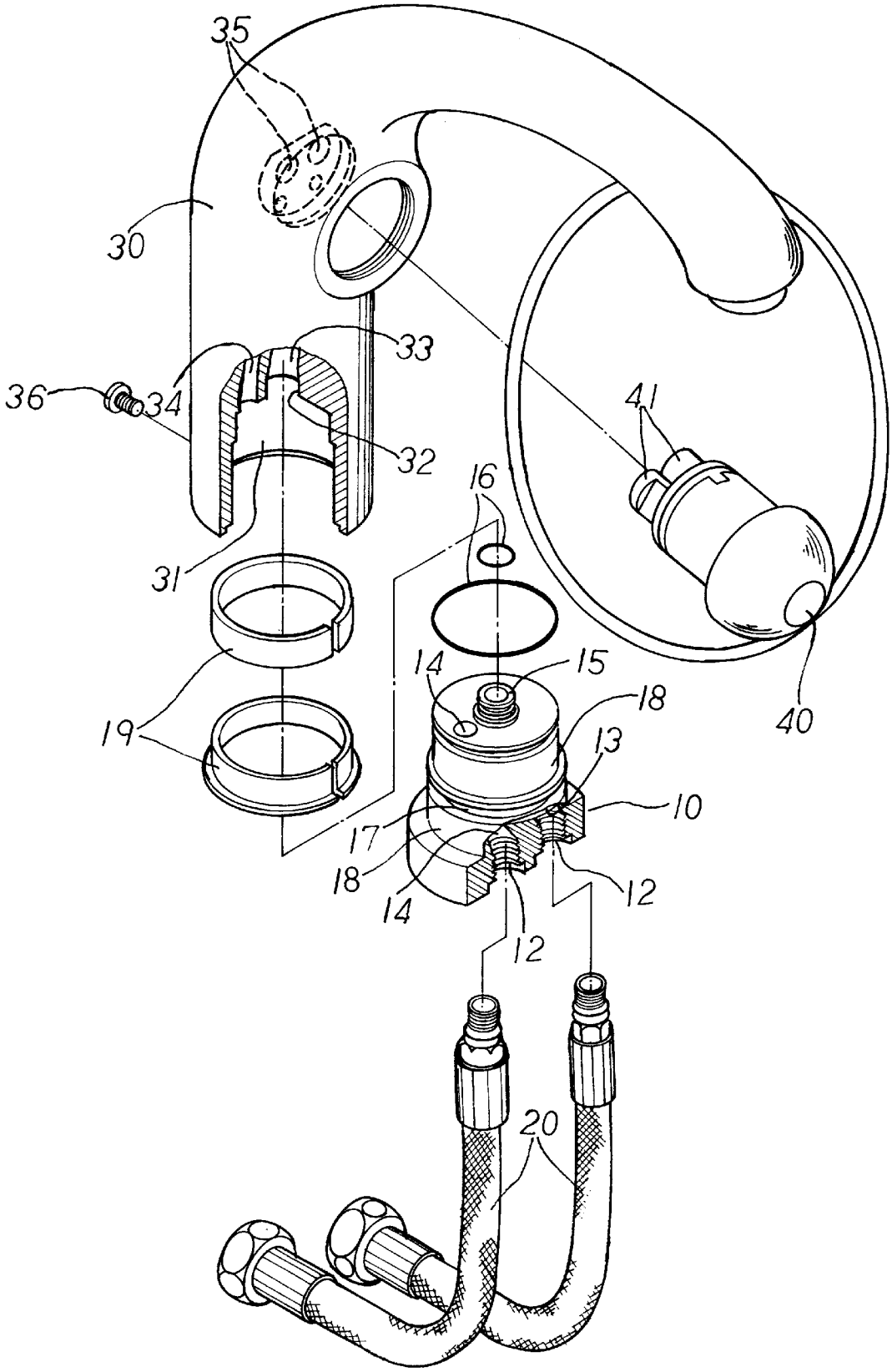
FIG. 1 is an exploded view of a kitchen use faucet structure in accordance with the present invention.
Figure 2:
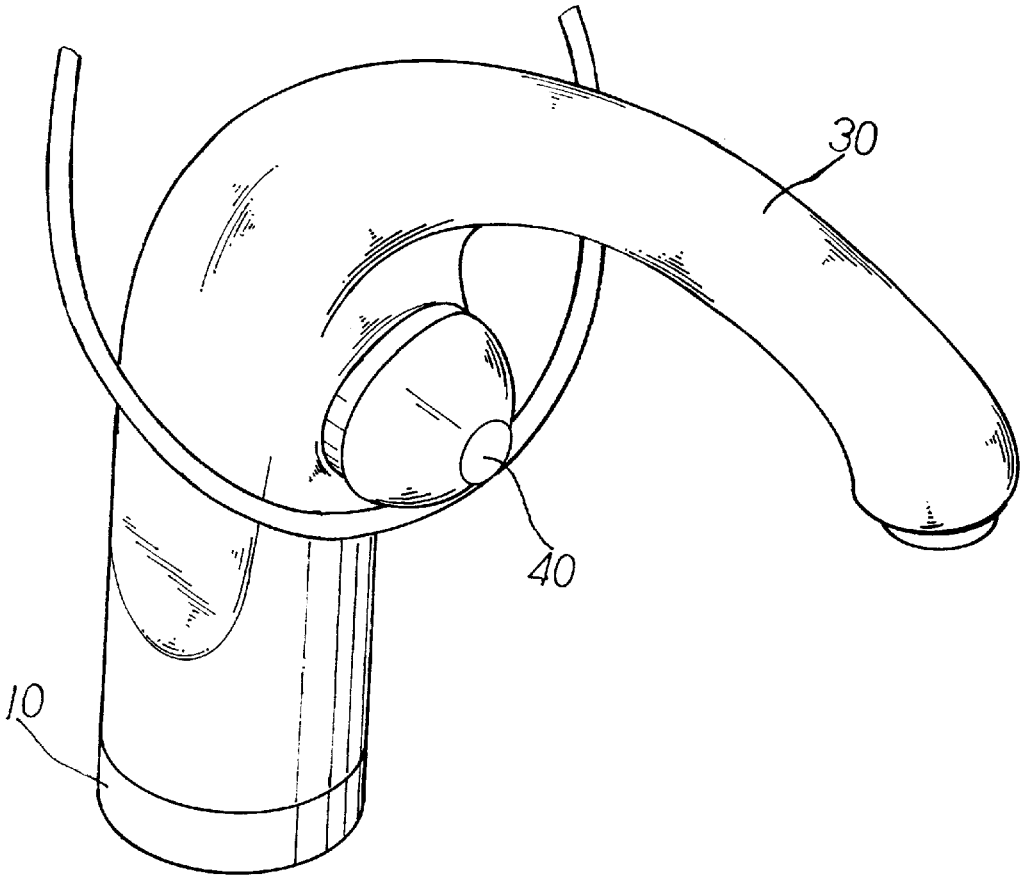
FIG. 2 is a perspective assembly view of the kitchen use faucet structure as shown in FIG. 1.

Referring to FIGS. 1–5, a kitchen use faucet structure in accordance with the present invention comprises a cylindrical fixed base 10, two cold/hot water tubes 20, a faucet 30, and a control device 40.

The cylindrical fixed base 10 having a lower end defining two fixed screw holes 11 for locking the fixed base 10 to the sink of the kitchen by means of two screws. The lower end of the cylindrical fixed base 10 is provided with two threaded introducing holes 12 for securing the lower end of the fixed base 10 to the two cold/hot water tubes 20 respectively. A cold water introducing chamber 13 is defined in the fixed base 10 and has an inlet connecting to one of the two introducing holes 12 and an outlet extending to the top of the fixed base 10 and provided with a cold flow tube 15 protruding outward. A hot water introducing chamber 14 is defined in the fixed base 10 and has an inlet connecting to the other of the two introducing holes 12 and an outlet extending to the top of the fixed base 10 and located adjacent to the cold flow tube 15. The cold flow tube 15 and the upper end of the fixed base 10 each have an outer wall defining an annular groove for receiving a sealing ring 16. An annular limiting groove 17 is defined in the outer wall of the mediate portion of the fixed base 10. The limiting groove 17 has a top and a bottom each having an abutting step 18 for supporting a slide sleeve 19 which is slidable in the inner wall of the lower end fitting hole 31 of the faucet 30 for facilitating the faucet 30 pivoting on the fixed base 10.

The faucet 30 has a lower end defining a lower end fitting hole 31 for receiving the fixed base 10 therein and defining a screw hole for allowing passage of a locking screw 36 which is secured in the annular limiting groove 17 of the fixed base 10 so that the faucet 30 is pivoted on the fixed base 10.

A cold water fitting hole 32 is defined in the top of the lower end fitting hole 31 of the faucet 30 for receiving the cold flow tube 15. A cold water chamber 33 is defined in the upper end of the faucet 30 and connects to the cold water fitting hole 32. A hot water chamber 34 is defined in the top of the lower end fitting hole 31 of the faucet 30 and connects to the outlet of the hot water introducing chamber 14. The cold water chamber 33 and the hot water chamber 34 each have an upper end defining a fitting hole 35 for receiving two fitting posts 41 of the control device 40.

In assembly, the fixed base 10 is locked on the sink of the kitchen by means of two screws, with the two introducing holes 12 for securing the two cold/hot water tubes 20. The faucet 30 is then mounted on the fixed base 10 with the fixed base 10 being fitted into the lower end fitting hole 31 of the faucet 30 while the cold flow tube 15 of the fixed base 10 is secured fitted into the cold water fitting hole 32, and the sealing ring 16 secured on the outer wall of the upper end of the fixed base 10 and the inner wall of the lower end fitting hole 31 of the faucet 30 are pressed to stop the water. The locking screw 36 then extends through the screw hole defined in the rear wall of the lower end fitting hole 31 of the faucet 30, and is then secured in the annular limiting groove 17 of the fixed base 10 so that the faucet 30 is pivoted on the fixed base 10.

Figure 3:
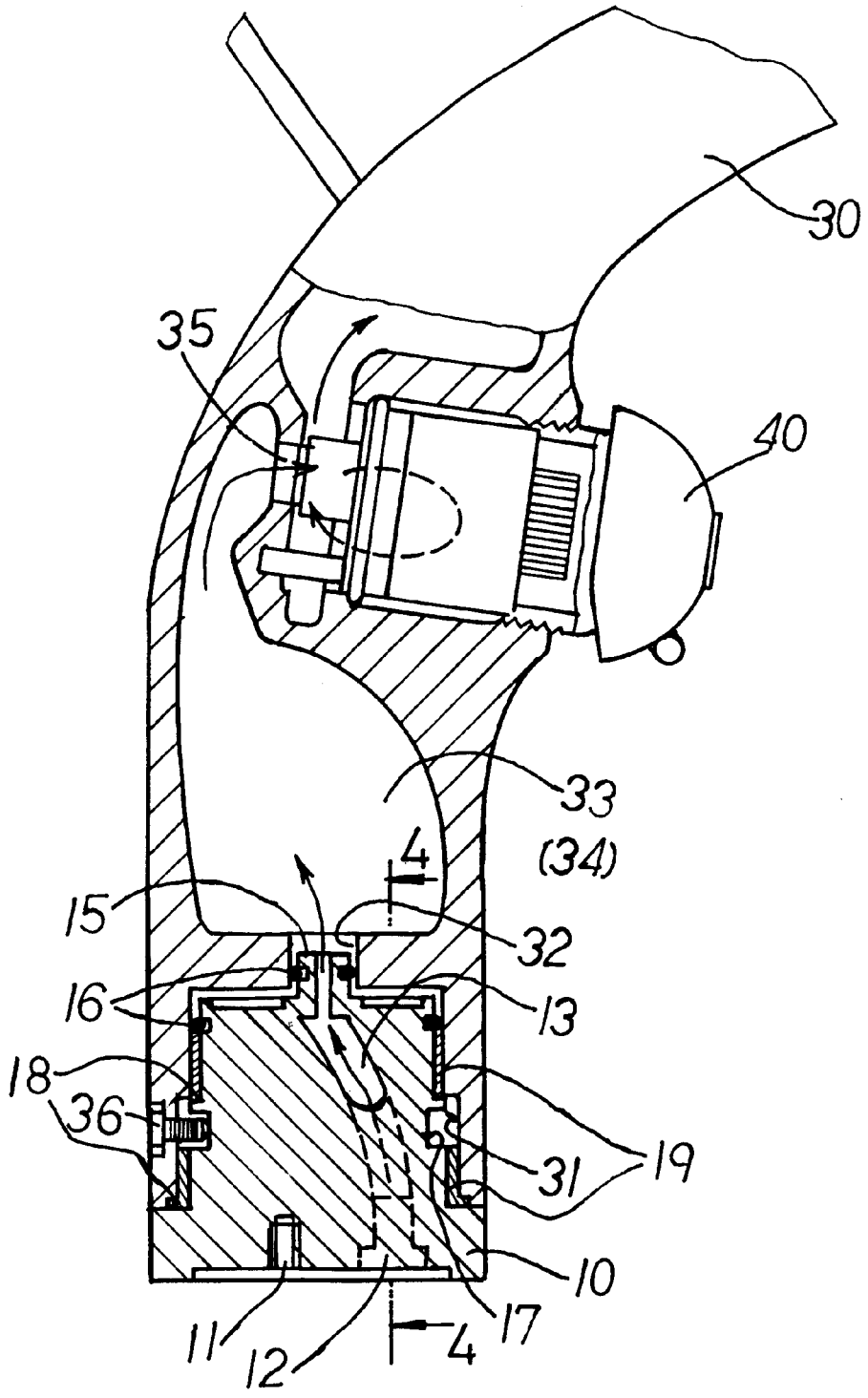
FIG. 3 is a side plan partially cross-sectional assembly view of the kitchen use faucet structure as shown in FIG. 1.
Figure 5:
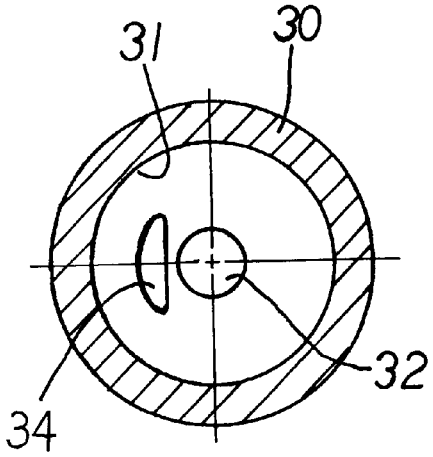
FIG. 5 is a cross-sectional view taken along the section line 5—5 of FIG. 4.
Figure 4:
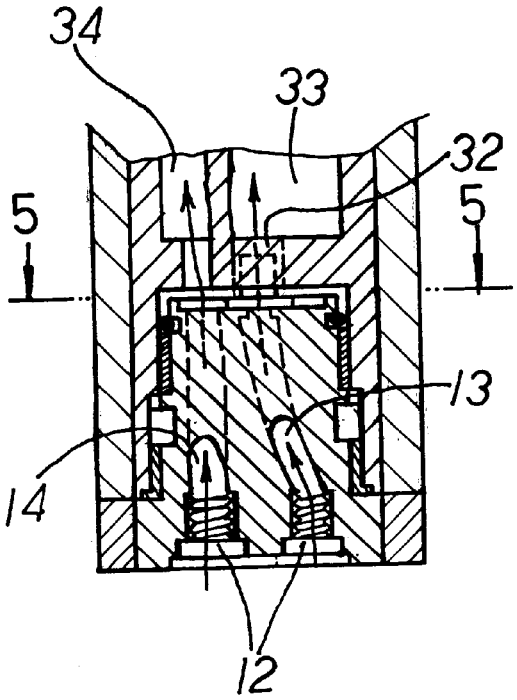
FIG. 4 is a cross-sectional view taken along the section line 4—4 of FIG. 3.

As shown in FIGS. 3, 4, and 5, the two sealing rings 16 secured on the annular groove defined in the outer wall of the cold flow tube 15 and the upper end of the fixed base 10 are used for stopping the water. A closed water chamber is defined between the end face of the fixed base 10 and the upper wall of the lower end fitting hole 31 of the faucet 30 and connects to the hot water chamber 34 so that when the faucet 30 is pivoted on the fixed base 10, the cold water and the hot water can be conveniently introduced into the cold water chamber 33 and the hot water chamber 34, and can then be guided into the fitting hole 35 of the faucet 30 and into the control device 40 so that the cold water and the hot water are mixed in the control device 40 so as to be drained outward from the spout of the upper section of the faucet 30.

Accordingly, according to the kitchen use faucet structure of the present invention, the two cold/hot water tubes 20 are locked to the fixed base 10 which is stationary so that the pivotal action of the faucet 30 on the fixed base 10 will not effect or distort the two cold/hot water tubes 20 at al, thereby enhancing the versatility and mobility of the faucet structure. Therefore, the faucet 30 can be arbitrarily pivoted on the fixed base 10 by 360 degrees.

It should be clear to those skilled in the art that further embodiments may be made without departing from the scope of the present invention.

What is claimed is:

1. A kitchen use faucet structure comprising: a cylindrical fixed base (10) having a lower end defining two fixed screw holes (11) for locking said fixed base (10) to a sink by two screws, a faucet (30) having a lower end fitting hole (31) for receiving said fixed base (10) therein and having a screw hole for allowing passage of a locking screw (36) which is secured in an annular limiting groove (17) which is defined in an outer wall of a mediate portion of said fixed base (10) so that said faucet (30) is pivoted on said fixed base (10), said limiting groove (17) having a top and a bottom each having an abutting step (18) for supporting a slide sleeve (19) which is slidable in an inner wall of said lower end fitting hole (31) of said faucet (30) for facilitating said faucet (30) pivoting on said fixed base (10), the improvement comprising: said lower end of said fixed base (10) being provided with two threaded introducing holes (12) for securing said lower end of said fixed base (10) to two cold/hot water tubes (20); a cold water introducing chamber (13) defined in said fixed base (10) and having an inlet connecting to one of said two introducing holes (12) and an outlet extending to a top of said fixed base (10) and provided with a cold flow tube (15) protruding outward; a hot water introducing chamber (14) defined in said fixed base (10) and having an inlet connecting to the other of said two introducing holes (12) and an outlet extending to the top of said fixed base (10) and located adjacent to said cold flow tube (15); said cold flow tube (15) and an upper end of said fixed base (10) each having an outer wall defining an annular groove for receiving a sealing ring (16); a cold water fitting hole (32) defined in a top of said lower end fitting hole (31) of said faucet (30) for receiving said cold flow tube (15), a cold water chamber (33) defined in an upper end of said faucet (30) and connecting to said cold water fitting hole (32), a hot water chamber (34) defined in the top of said lower end fitting hole (31) of said faucet (30) and connecting to said outlet of said hot water introducing chamber (14), said cold water chamber (33) and said hot water chamber (34) each having an upper end defining a fitting hole (35) for receiving two fitting posts (41) of a control device (40).

* * * * *